US005743071A

United States Patent [19]

Wolthuizen

[11] Patent Number: 5,743,071

[45] Date of Patent: Apr. 28, 1998

[54] ASSEMBLY FOR AUTOMATIC PACKAGING OF SERIES OF ARTICLES OR PRODUCTS DELIVERED ON CONVEYOR BELTS

[76] Inventor: Huite Wolthuizen, De Koppele 3, NL-5632 LE Eindhoven, Netherlands

[21] Appl. No.: 408,243

[22] Filed: Mar. 22, 1995

[30] Foreign Application Priority Data

Dec. 13, 1994 [NL] Netherlands ..... 94 02 112

[51] Int. Cl.[6] ..... B65B 43/14

[52] U.S. Cl. ..... 53/571; 53/493; 53/252; 53/385.1

[58] Field of Search ..... 53/252, 258, 259, 53/260, 384.1, 570, 571, 381.5, 55, 58, 493, 498, 64, 68, 202, 572, 573

[56] References Cited

U.S. PATENT DOCUMENTS

| | | | |
|---|---|---|---|
| 2,133,367 | 12/1938 | Wagner | 53/175 |
| 4,241,562 | 12/1980 | Meyer | 53/258 |
| 4,248,032 | 2/1981 | Woods et al. | 53/570 |
| 4,269,016 | 5/1981 | Kopp et al. | 53/202 |
| 4,850,178 | 7/1989 | Ausnit | 53/202 |
| 5,024,042 | 6/1991 | Meyer | 53/571 |
| 5,152,124 | 10/1992 | Ishii et al. | 53/570 |
| 5,209,046 | 5/1993 | Japscott et al. | 53/258 |
| 5,247,782 | 9/1993 | Rejsa | 53/252 |
| 5,327,704 | 7/1994 | Hoeckzena et al. | 53/252 |
| 5,467,577 | 11/1995 | Sato | 53/493 |
| 5,477,662 | 12/1995 | Rompa | 53/573 |

*Primary Examiner*—John Sipos
*Assistant Examiner*—Ed Tolan
*Attorney, Agent, or Firm*—William A. Drucker

[57] ABSTRACT

A device for packaging large series of similar articles or products which are delivered upon conveyor belts or the like, and wherein each subject to be packed is moved from the conveyor, while a bag is taken from a holder, blown up by air and kept by two gripper spoons, such that the bag can slip over the object, and the object is kept in the bag by a pusher.

9 Claims, 6 Drawing Sheets

ASSEMBLY FOR AUTOMATIC PACKAGING OF SERIES OF ARTICLES OR PRODUCTS DELIVERED ON CONVEYOR BELTS

The present invention relates in general to a packaging machine for the automatic packaging at high speed of large amounts of relatively small articles or products which are delivered upon conveyor belts and roller conveyors.

Such articles and products are generally of identical or similar shape and are put up and delivered in series of lines upon moving conveyors.

Assemblies of devices for packaging of such objects from stocks generally comprise a bag holder placed aside of the end of a conveyor belt, which holder contains a number of bags of suitable size, and from that holder each bag in turn is caught by a gripper, such that the opening of the bag is directed towards the conveyor means, and the bag is then blown up, while a pair of keeping spoons is pushed into the bag, in such a way that the bag is being kept strained between the spoons, whereupon the bag is drawn around the object, article or product. A device of this kind is described in U.S. Pat. No. 3,556,316. It comprises a number of bag holders from which optionally bags are drawn by a cam and then drawn around the product to be packed.

Another device of this kind is described in NL-A-92 00 716, relating to conveyance means having a horizontal conveyor platform, which extends underneath of gripper means, and which is provided with a tilting part, whereby a bag can be pushed over the object in a horizontal position. A mechanical system of movable rods is connected with the gripper to carry out the packaging operation.

These devices however are not operating very fast, and the packaging phase is due to interferences, and hence breakdowns cannot be prevented. Moreover soft products such as sliced bread, cake and other food products, as well as irregularly shaped objects, such as bread rolls, grocery and the like, could break or crumble, which causes interruptions. For many other things, like games and toys, this packaging device is not practically applicable.

Moreover the mechanical moving rods assemblies are consuming much energy, operate rather slowly and need large space, which is often not available in shops and warehouses. The primary object of the present invention is to provide an improved fully automatic packaging assembly, being of compact construction, whereby it works economically.

This invention resides in novel features of construction, combination and arrangement of elements and parts of same, as will be hereinafter described in detail in the specification and pointed out in the appended claims, and as illustrated in the accompanying drawings, which form a material part of this application and in which:

In these figures identical numerals of reference designate identical elements or portions of same throughout the specification and throughout the different views of the accompanying drawings.

Figure 1:
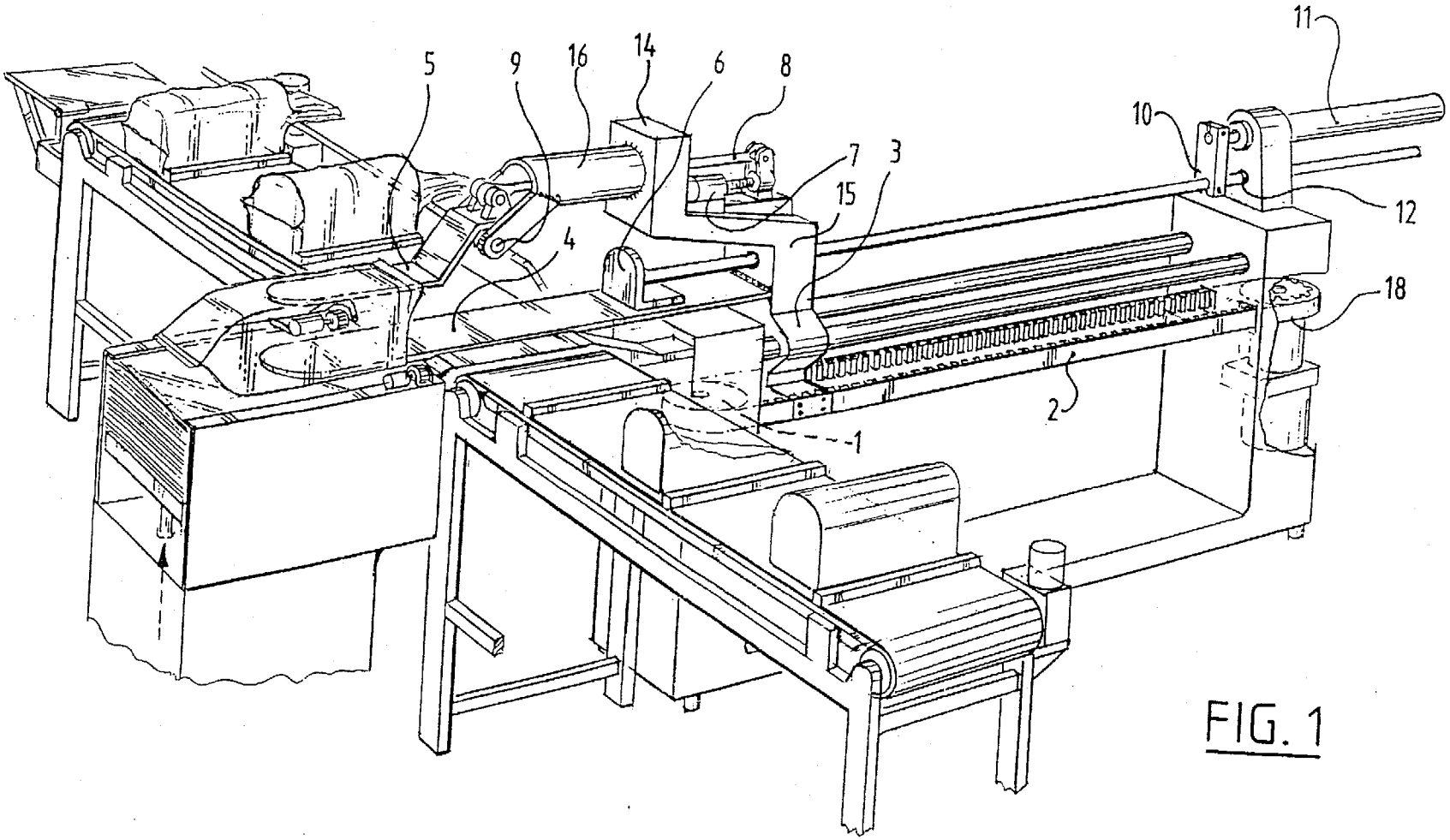
FIG. 1 is an elevational and a horizontal sectional view of a single-acting packaging device according to the present invention.
Figure 2:
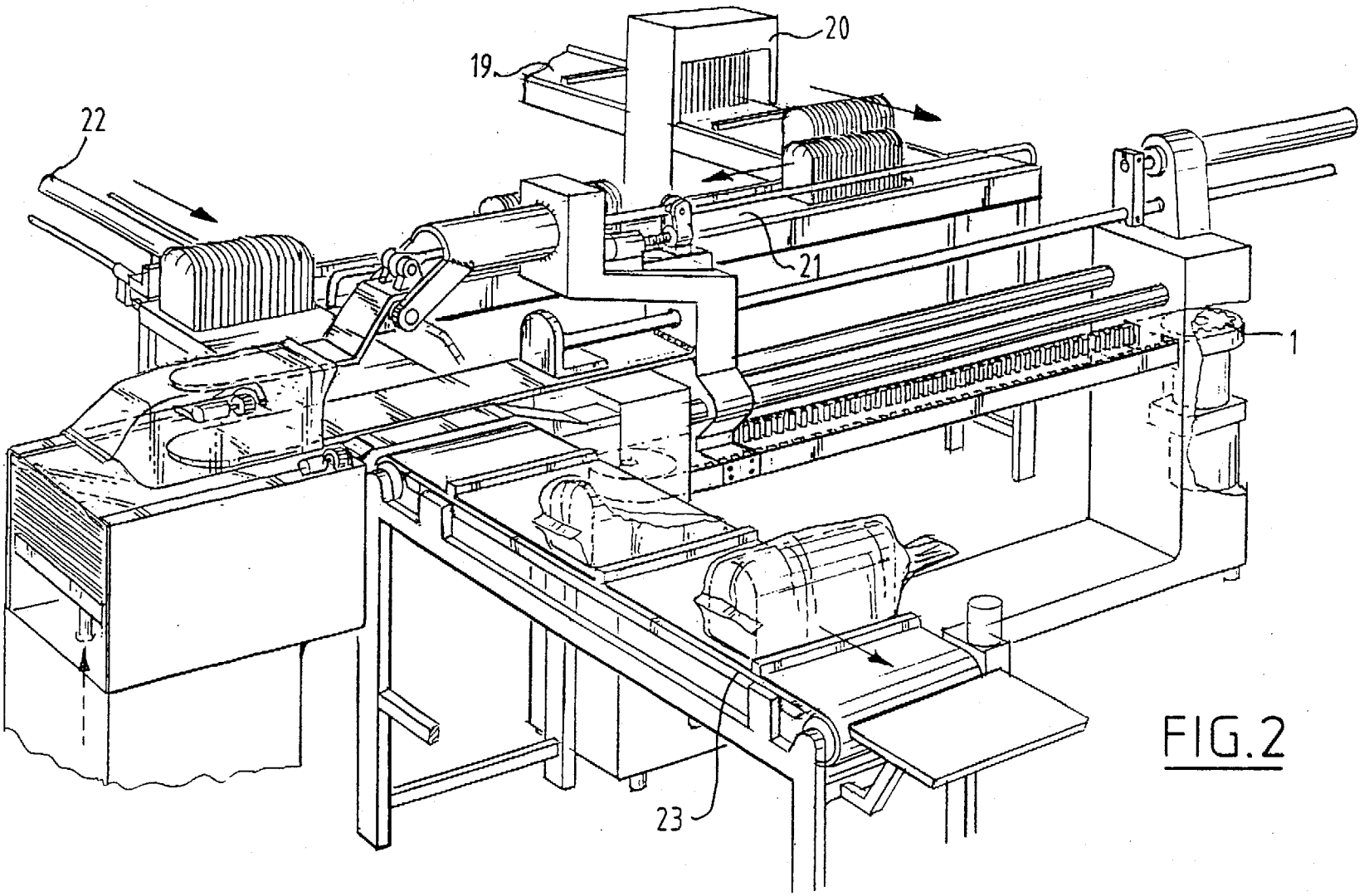
FIG. 2 is a horizontal sectional view of the single-acting machine with product delivery track parallel to the gripper spoon mechanism.
Figure 3:
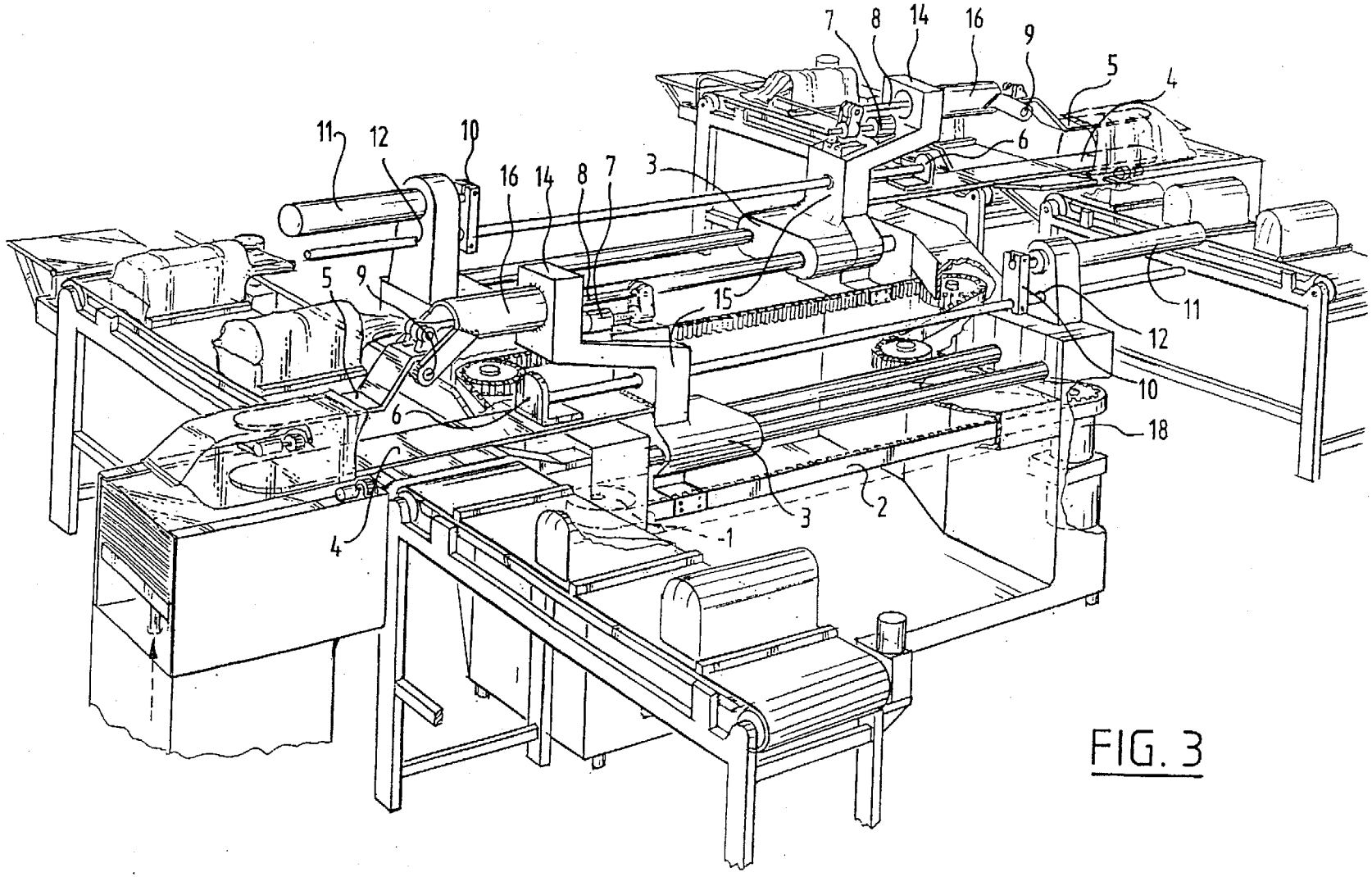
FIG. 3 shows an elevational and a horizontal sectional view of a double-acting packaging machine according to the present invention.
Figure 4:
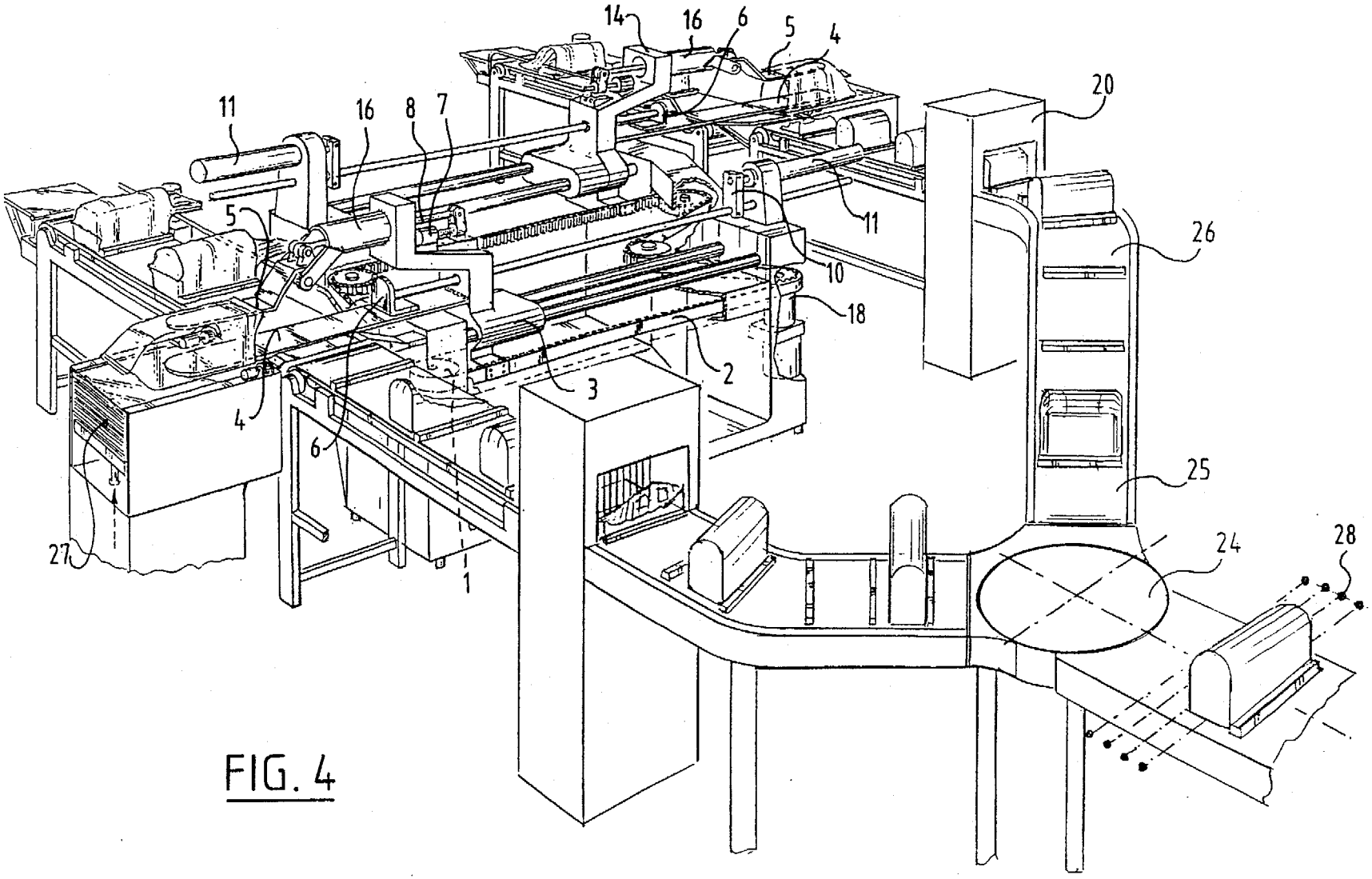
FIG. 4 is a horizontal partly sectional view of a double-acting machine according to the invention, with supply means for several different products, provided with a distributing plate.
Figure 5:
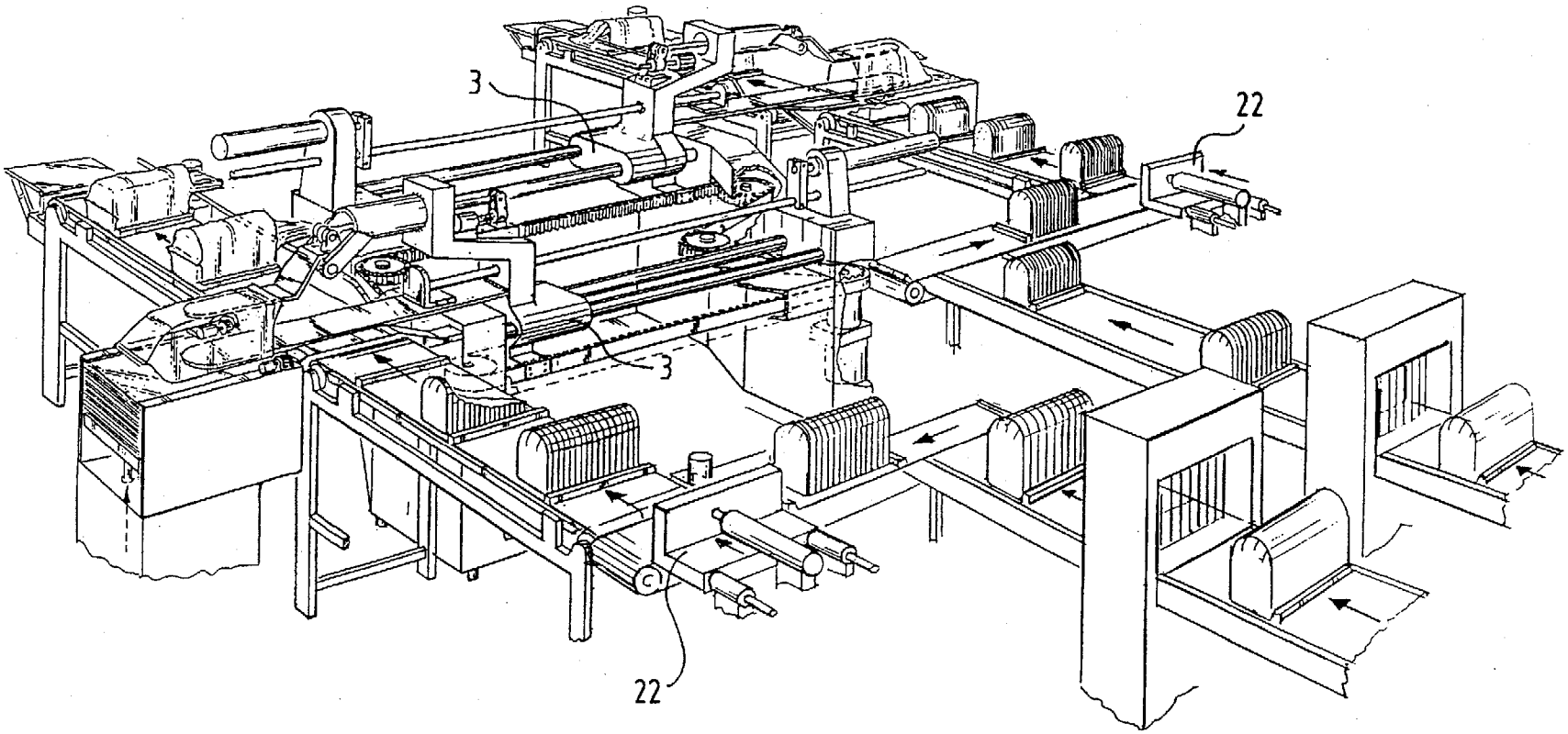
FIG. 5 is a horizontal view of a double-acting packaging machine with two product supplies parallel to the gripper spoon mechanism of the machine.
Figure 7:
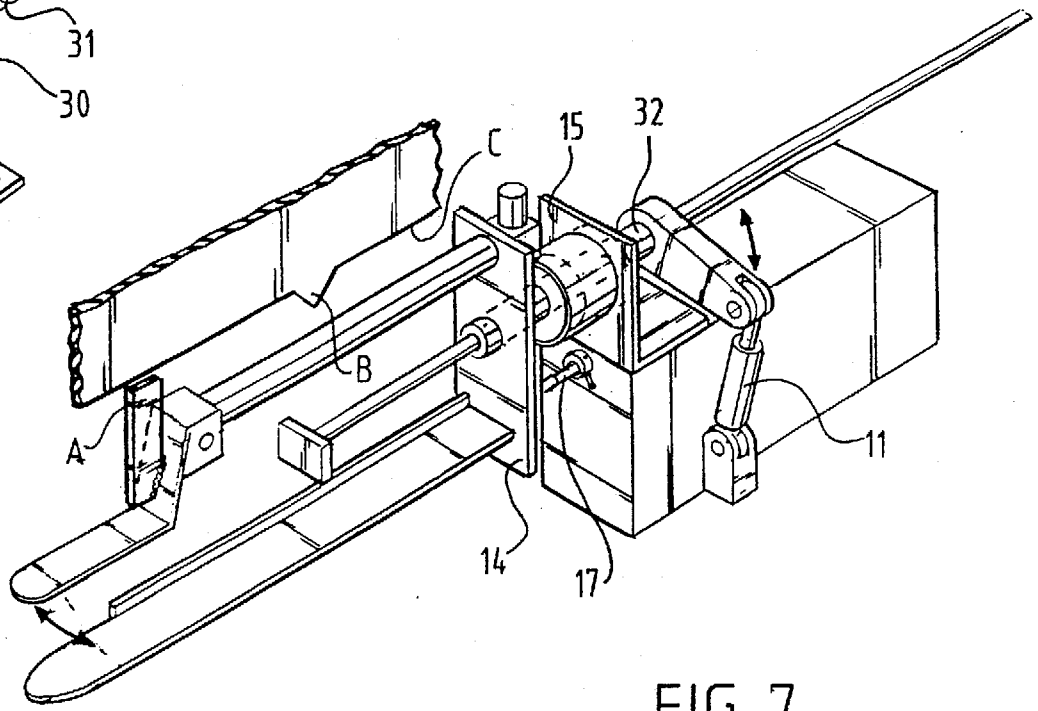
FIG. 7 shows a tilting assemblage, a spoon yoke and spoon bracket of the gripper part, which are rotatably mounted with a hollow shaft, kept in a radial ball bearing and shows schematically the action of a quick-acting chuck lever for the lower gripper spoon, operatied by an air cylinder.
Figure 6:
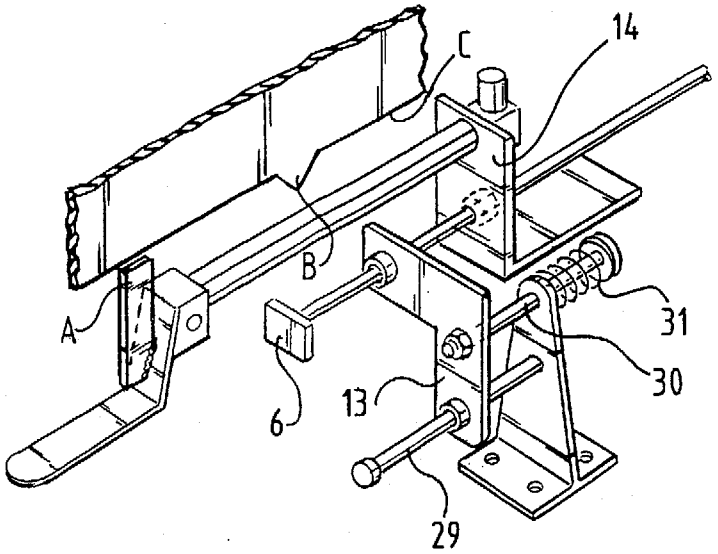
FIG. 6 shows schematically the detail of the movable bearing of the bracket of the gripper spoon with a guider stem, a spring bar and a pressure spring. This bearing is slidable, such that the bearing block cannot be damaged, in case that by incorrect adjustment of the stroke the bearing will slide over a guider stem, whereas a spring bar tensions a pressure spring.

The numerals are identifying the construction parts as follows:

1. Pulley disc.
2. Toothed belt.
3. Slide element.
4. Lower spoon of gripper.
5. Upper spoon of gripper.
6. Pusher.
7. Servo motor with worm wheel housing for gripper.
8. Servo motor shaft.
9. Pinion with shaft of spoon.
10. Sliding rod.
11. Air cylinders.
12. Bearing bushes.
13. Movable bearing block.
14. Spoon yoke of gripper.
15. Spoon bracket.
16. Spoon tubing.
17. Quick-connecting device.
18. Servo motor for pulley disc.
19. Conveyor track.
20. Cutters (optional).
21. Feeder catch.
22. Sliding cam.
23. Discharge catch.
24. Distributing plate.
25. Conveyor track.
26. Roller frame.
27. Bag holder.
28. Sensors (opto-electronic with glassfibre leads to circuit).
29. Guider stem.
30. Spring bar.
31. Pressure spring.
32. Hollow pivot.
A. Protrusion.
B. Cam.
C. Cam track.

The assembly according to the present invention operates as follows:

The movements of the parts are synchronously performed and controlled in velocity by means of a programme for the electrical circuit with electronic switches, operated by said programme and opto-electronic sensors. The motors are servo motors directed by servo switch boxes.

The packaging bags, e.g. of plastic foil, paper or other adequate material, are stored in an open holder (27) horizontally next to the conveyor (19) line. The upper edges of the bags have a joggle slip, which is partly slightly longer than the length of the bag and which is provided with two apertures to facilitate gripping the bag.

Each bag is individually taken by and moved towards the gripper spoon assembly by means of a cam control, and then blown up to a moderate extent in such a manner, that the gripper spoons of the packaging device can slide into the bag. The bag is during this operation somewhat strained by an air supply.

The lower spoon remains in horizontal position and extends from the spoon bracket at a spoon yoke till the inner side of the bag. The upper spoon however is curved. The spoon shaft is coupled at the axle of a servo motor by means of a pinion, and said axle is positioned within a horizontal tube.

Thus the upper spoon is significantly shorter than the lower spoon. The combination of the spoons is not forced to run into the entire way through a long bag. It is slipped into the bag in a collapsed position.

The product or article, which is to be packed, is moved sidewise and kept in the bag by means of a pusher, and the upper side (a joggle strip) of the bag can be closed with a closing strip or, if the bag is of plastic, it can be closed by heat sealing. Further the packaged product or article is pushed upon a second conveyor belt or line and carried off. The upper spoon has a protrusion which cooperates with a cam track to pivot the upper spoon back to its closed position at the end of the packaging cycle to release the bag.

In stead of air, an inert gas can be used to blow up the bag, if the product is sensitive to air.

The drive of the device has two sources: electricity for servo motors and airpressure from cylinders with compressed air.

An alternating programme in a printed circuit switching a servo motor is the control of the drive which is entirely automatical.

The programme is elaborated with sinusoidal wave curve performance of the switching circuitry.

The assembly can be a double-acting machine (twin-type), serving four conveyor belts in total by means of a multi-disc drive. The supply can be a feeder service for different products and this can be handled with a distributor unit, which divides the delivered products stream into two or more rows for two or more conveyor lines. The supply may be parallel or perpendicular to the direction of movement of the spoons of the packaging machine.

In the case of supply perpendicular to the direction of the movement of the spoons the lower and the upper spoon are pushed into the blown-up bag in collapsed position and further clamped by the movable upper spoon, with previously adjusted force by the servo motor. Thereupon the product caught by a feeder catch leaves the supply conveyor and it slides upon a bevelled guiding surface, after which the spoons move towards the pusher. Said pusher stops the product while the combination of spoons moves to the reverse position, so that the bag is drawn around the product, until the bottom of the bag reaches the extremity of the article or product.

Then the set-up gripping power is reduced by the servo control and the bag with the product is tilted and dropped from the combination of spoons upon the discharge conveyor track.

During the dropping movement the pusher and a length of the combination of spoons is drawn out of the remaining length of the bag.

This is the upper side (the joggle strip), which can be closed either mechanically or by sealing.

If the product is supplied in a direction parallel to the direction of movement of the spoons the product is transported and handled in the same manner.

In an alternative embodiment of the present invention as a double-acting packaging machine one servo motor only by means of pulley discs drives a toothed belt which keeps a slide on each half.

Both slides perform a lead and return movement. Upon each slide a combination of spoons is mounted. According to this embodiment the combinations of spoons are positioned with regard to the other as a reflected image. Driven by a servo motor at every turn two products are packaged in one stroke so that the processing capacity rate per time unit is doubled, whereas the energy consumption remains the same.

The double acting packaging machine with feed conveyors perpendicular to the direction of the movement of the spoons can be provided with a distributor plate. The product is conveyed by the belt or line towards the distributing point and there it is sorted by sensor control and directed to a left-or right-hand conveyor belt. The sensors are mechanical and opto-electronic gauges, and the signal for movement is transmitted by a line suited to the purpose, e.g. a glass-fiber cable, which is conducted with the switching circuit.

In an arrangement of this kind it is perfectly possible to supply products or articles from a stock of different sizes and shapes in one sequence series, and further to package these with high speed in assorted categories for storage.

Also a double acting packaging machine with feed conveyors parallel to the direction of the movement of the spoons can be used to sort and package supplied series of different products.

This is an advantage for alimentary products, such as bread, cheese, meat products, grocery, tobacco articles etc.

I claim:

1. An apparatus for automatically packing in bags a series of articles comprising: a first conveying means for delivering the articles, a bag holder arranged next to the first conveying means for supporting the bags, a first gripper assembly comprising a substantially horizontally extending lower spoon and an upper spoon that is pivotable about a horizontal axis, said spoons being carried at their proximal ends by a spoon yoke that is mounted on a reciprocating spoon bracket, said spoon bracket being horizontally movable in a direction substantially perpendicular to the delivery direction of the first conveying means, so as to move the spoons between a first or idle position adjacent the first conveying means and opposite the bag holder and a second or pick-up position in which the spoons extend across the first conveying means into a bag supported by the bag holder, a pusher member arranged between the spoons and movable between an idle position adjacent the first conveying means opposite the bag holder and a blocking position over the first conveying means, and a second conveying means for carrying off the articles packed in the bags to a storage;

wherein the spoon bracket is supported by a slide element that is mounted on an endless belt or chain, said belt or chain being guided over at least two pulleys, at least one of which is driven by a first drive means under control of an electronic control system, said drive means turning said driven pulley back and forth over an angle corresponding to the required stroke of the spoons between their first and second positions;

wherein said upper spoon is drivably connected to a second drive means controlled by said electronic control system, said upper spoon being movable by said second drive means from a closed position in which its distal end is adjacent said lower spoon to an open position in which its distal end is removed from said lower spoon for opening a bag; and wherein the upper spoon comprises a protrusion cooperating with a cam track that is fixedly arranged in the apparatus, whereby the upper spoon is pivoted back to its closed position at the end of a packaging cycle, thus releasing the bag.

2. The apparatus of claim 1 wherein the apparatus is double acting and comprises at least one second gripper assembly with associated first and second conveying means for delivering articles to the gripper assembly and carrying off packed articles, respectively, the second gripper assembly being substantially identical to the first gripper assembly, its spoon bracket also being moved by an endless belt or chain, said belt or chain sharing at least one pulley with the belt or chain of the first gripper assembly.

3. The apparatus of claim 2 wherein the first and second gripper assemblies are drivably connected to a common drive belt or chain.

4. The apparatus of claim 3 wherein the first and second gripper assemblies are arranged back-to-back and their strokes between their respective first and second positions are synchronized.

5. The apparatus of claim 4 wherein there is a turntable type distributor unit arranged upstream of the first conveying means for distributing articles to be packed over the first and second gripper assemblies.

6. The apparatus of claim 5 wherein there are sensor means arranged near the distributor unit for sensing the shape and/or dimensions of the articles supplied to said distributor unit, the sensor means being connected to said electronic control unit, and said electronic control unit in turn being connected to said distributor unit for controlling the position of said turntable and thus the distribution of the articles over the first and second gripper assemblies depending on their shape and/or dimension.

7. The apparatus of claim 1 wherein the pusher member is slidably received in a pair of bearings, at least one of which is arranged in the spoon yoke, and the foremost of which is arranged in a bearing block that is movably arranged in the apparatus and is kept at a predetermined distance from the bearing in the spoon yoke by a biasing spring.

8. The apparatus of claim 1 wherein the bag holder is adjustably arranged, so as to allow the position of the bag holder to be adapted to the length of the articles to be packed.

9. The apparatus of claim 1 wherein the lower spoon is releasably mounted in the spoon yoke by means of a quick release mechanism.

* * * * *